US006144287A

United States Patent [19]

Komeda

[11] Patent Number: 6,144,287

[45] Date of Patent: Nov. 7, 2000

[54] CHIP RESISTOR AND METHOD FOR MANUFACTURING THE SAME

[75] Inventor: Masayoshi Komeda, Kyoto, Japan

[73] Assignee: Rohm Co., Ltd., Kyoto, Japan

[21] Appl. No.: 09/202,508

[22] PCT Filed: Jun. 25, 1997

[86] PCT No.: PCT/JP97/02219

§ 371 Date: Dec. 15, 1998

§ 102(e) Date: Dec. 15, 1998

[87] PCT Pub. No.: WO97/50095

PCT Pub. Date: Dec. 31, 1997

[30] Foreign Application Priority Data

| | | | |
|---|---|---|---|
| Jun. 26, 1996 | [JP] | Japan | 8-165912 |
| Jun. 26, 1996 | [JP] | Japan | 8-165913 |
| Jun. 26, 1996 | [JP] | Japan | 8-165914 |

[51] Int. Cl.[7] ..... H01C 10/00

[52] U.S. Cl. ..... 338/195; 338/309; 338/313; 338/254; 29/620

[58] Field of Search ..... 338/307, 309, 338/195, 313, 254, 255; 29/620

[56] References Cited

U.S. PATENT DOCUMENTS

| | | | |
|---|---|---|---|
| 3,699,650 | 10/1972 | Cocca | 29/620 |
| 4,403,133 | 9/1983 | Turner et al. | 219/121.69 |
| 4,792,781 | 12/1988 | Takahashi et al. | 338/307 |
| 5,379,017 | 1/1995 | Katsuno | 338/313 |
| 5,510,594 | 4/1996 | Mori et al. | 219/121.69 |
| 5,966,067 | 8/1992 | Hashimoto | 338/195 |

FOREIGN PATENT DOCUMENTS

| | | | |
|---|---|---|---|
| 1-152701 | 6/1989 | Japan . | |
| 4214601 | 8/1992 | Japan | 338/195 |
| 6-84618 | 3/1994 | Japan . | |

OTHER PUBLICATIONS

International Search Report for PCT/JP97/02219, Oct. 7, 1997.

*Primary Examiner*—Karl Easthom
*Attorney, Agent, or Firm*—Merchant & Gould P.C.

[57] ABSTRACT

A chip resistor is provided which includes: an insulating substrate (1); a pair of main electrodes (2, 3) formed on a surface of the insulating substrate (1) and spaced from each other; a resistor film (4) formed on the surface of the insulating substrate (1) to bridge between the main electrodes (2, 3), the resistor film (4) being provided with a trimming groove (6) for resistor adjustment; a protective coating (5, 7, 8) formed to cover the resistor film (4); and a metal plating (13, 14) formed in electrical conduction with each of the main electrodes (2, 3). The trimming groove (6) has a width which is no less than 80 $\mu$m but smaller than an interval between the main electrodes (2, 3), and is formed at an inclination angle of 20–45 degrees with respect to the substrate. Three glass coat layers are also employed.

17 Claims, 3 Drawing Sheets

CHIP RESISTOR AND METHOD FOR MANUFACTURING THE SAME

TECHNICAL FIELD

The present invention relates to a chip resistor including a chip-type insulating substrate and at least one resistor film formed thereon, and to a method of making such a chip resistor.

BACKGROUND ART

A conventional chip resistor of this kind includes an insulating substrate, a pair of main electrodes formed on a surface of the insulating substrate and spaced from each other, a resistor film which is formed on the surface of the insulating substrate to bridge between the main electrodes and provided with a trimming groove for resistor adjustment, a protective coating formed to cover the resistor film, and a metal plating formed in electrical conduction with each of the main electrodes, as disclosed in Japanese Patent Application Laid-open Nos. 56-148804 and 4-102302 for example. The protective coating includes an undercoat layer of glass formed on the resistor film, a middle-coat layer of glass formed on the undercoat layer and an overcoat layer formed on the middle-coat layer. The trimming groove may be formed by irradiating the resistor film with e.g. a laser beam from above the undercoat layer. The metal plating is formed by solder-plating treatment after performing nickel-plating for the chip resistor as a whole.

The purpose of forming the middle-coat layer of glass on the chip resistor having the above arrangement is to seal the resistor film hermetically against the exterior air with the use of the glass-made middle-coat layer, and to fill up the trimming groove of the resistor film. However, it has been found that if the middle-coat layer is not properly formed, pinholes tend to be formed in the trimming groove, thereby breaking the sealing condition as described below.

Specifically, the middle-coat layer is formed by applying a glass paste by screen-printing and baking it at a substantially high temperature. However, at the time of applying a glass paste by screen-printing for the middle-coat layer, the glass paste often traps bubbles in the trimming groove formed in the resistor film and the undercoat layer. The bubbles will expand upon baking the glass paste, leading to generation of pinholes communicating with the exterior air. As a result, an amount of plating liquid flows into the pinholes during metal plating treatment performed subsequently, and metal plating pieces will grow therein.

If the pinholes are small, the growth of the metal plating pieces within the pinholes does not cause any particular problem. However, if the pinholes are large, the grown metal plating pieces in the pinholes will bridge between the side surfaces at the trimming groove, thereby causing the overall resistance of the resistor film to deviate from a predetermined value. Thus, conventionally, there has been a problem of high occurrence of rejective devices.

DISCLOSURE OF THE INVENTION

It is an object of the present invention to provide a chip resistor overcoming the above problem.

It is another object of the present invention to provide a method of making such a chip resistor.

According to a first aspect of the present invention, there is provided a chip resistor including an insulating substrate, a pair of main electrodes formed on a surface of the insulating substrate and spaced from each other, a resistor film formed on the surface of the insulating substrate to bridge between the main electrodes, the resistor film being provided with a trimming groove for resistor adjustment, a protective coating formed to cover the resistor film, and a metal plating formed in electrical conduction with each of the main electrodes, wherein the trimming groove has a width which is no less than 80 $\mu$m but smaller than an interval between the main electrodes.

The technical advantages obtainable from the above arrangement will be described in detail with reference to the embodiments described hereinafter.

Preferably, the width of the trimming groove is 90–150 $\mu$m. Advantageously, the trimming groove is inverted-trapezoidal in cross section. In this instance, the trimming groove preferably has a pair of inclined side surfaces, and each of the inclined side surfaces has an inclination angle of 20–45 degrees.

According to a preferred embodiment of the present invention, the protective coating includes an undercoat layer of glass formed on the resistor film, a middle-coat layer of glass formed on the undercoat layer, and an overcoat layer formed on the middle-coat layer. The trimming groove is formed through the undercoat layer and the resistor film. In this instance, the middle-coat layer preferably has a thickness of 5–10 $\mu$m.

Typically, the chip resistor further includes an auxiliary electrode formed on each of the main electrodes, and a side electrode formed on a side surface of the insulating substrate in electrical conduction with the auxiliary electrode and said each main electrode. The metal plating is formed to cover the auxiliary electrode and the side electrode.

According to a second aspect of the present invention, there is provided a chip resistor including an insulating substrate, a pair of main electrodes formed on a surface of the insulating substrate and spaced from each other, a resistor film formed on the surface of the insulating substrate to bridge between the main electrodes, the resistor film being provided with a trimming groove for resistor adjustment, a protective coating formed to cover the resistor film, and a metal plating formed in electrical conduction with each of the main electrodes, wherein the protective coating includes an undercoat layer of glass formed on the resistor film, a middle-coat layer of glass formed on the undercoat layer, and an overcoat layer formed on the middle-coat layer. The trimming groove is formed through the undercoat layer and the resistor film. The middle-coat layer has a thickness of 5–10 $\mu$m.

According to a third aspect of the present invention, there is provided a method of making a chip resistor including the steps of forming a pair of main electrodes on a surface of an insulating substrate to be spaced from each other, forming a resistor film on the surface of the insulating substrate to bridge between the main electrodes, forming an undercoat layer of glass to cover the resistor film, forming a trimming groove through the undercoat layer and the resistor film for resistance adjustment, forming a middle-coat layer of glass to cover the undercoat layer, forming an overcoat layer to cover the middle-coat layer, and forming a metal plating in electrical conduction with each of the main electrodes. The step of forming the trimming groove is performed so that the trimming groove has a width which is no less than 80 $\mu$m but smaller than an interval between the main electrodes.

According to a fourth aspect of the present invention, there is provided a method of making a chip resistor comprising the steps of forming a pair of main electrodes on a surface of an insulating substrate to be spaced from each other, forming a resistor film on the surface of the insulating substrate to bridge between the main electrodes, forming an undercoat layer of glass to cover the resistor film, forming a trimming groove through the undercoat layer and the resistor film for resistance adjustment, forming a middle-coat layer of glass to cover the undercoat layer, forming an overcoat layer to cover the middle-coat layer, and forming a metal plating in electrical conduction with each of the main electrodes. The step of forming the middle-coat layer is performed so that the middle-coat layer has a thickness of 5–10 μm.

Other objects, features and advantages of the present invention will become clearer from the embodiments described below with reference to the accompanying drawings.

BEST MODE FOR CARRYING OUT THE INVENTION

Preferred embodiments of the present invention will be described below with reference to the drawings.

Figure 1:
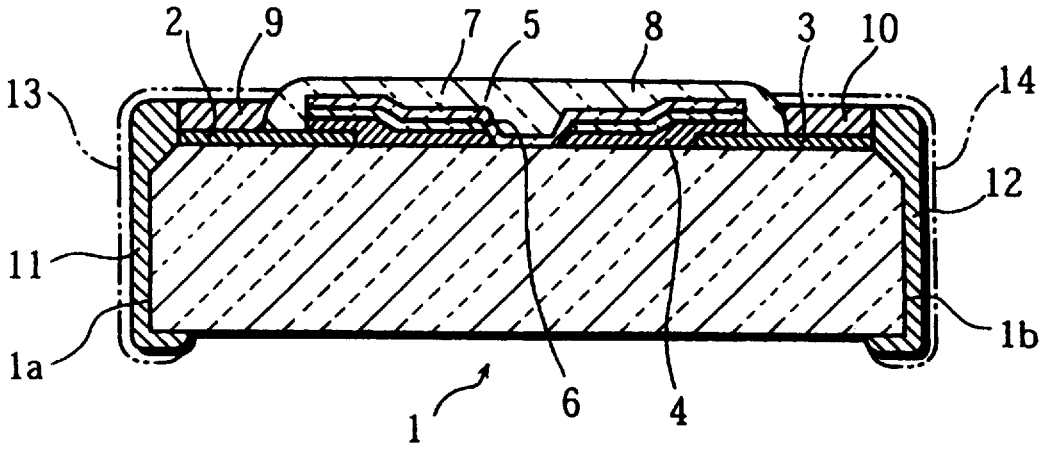
FIG. 1 is a longitudinally sectional view showing a chip resistor according to an embodiment of the present invention.

As shown in FIG. 1, a chip resistor according to an embodiment of the present invention includes a chip-type substrate 1 made of an insulating material such as ceramic for example, a pair of main electrodes 2, 3 formed on an upper surface of the substrate 1 and spaced from each other, and a resistor film 4 to bridge between the main electrodes 2, 3. The resistor film 4 is entirely covered by a protective coating which includes an undercoat layer 5, a middle-coat layer 7 and an overcoat layer 8. The resistor film 4 and the undercoat layer 5 is provided with a trimming grove 6 (see FIG. 4) for resistor adjustment. The middle-coat layer 7 and the overcoat layer 8 extend into the trimming groove 6.

Auxiliary electrodes 9, 10 are formed on the respective main electrodes 2, 3. Side electrodes 11, 12 are formed on a pair of mutually opposite side surfaces of the substrate 1 in electrical conduction with the main electrodes 2, 3 and the auxiliary electrodes 9, 10. Metal platings 13, 14 are formed on the auxiliary electrodes 9, 10 and the side electrodes 11, 12.

The chip resistor having the above arrangement may be produced by the following method for example.

Figure 2:
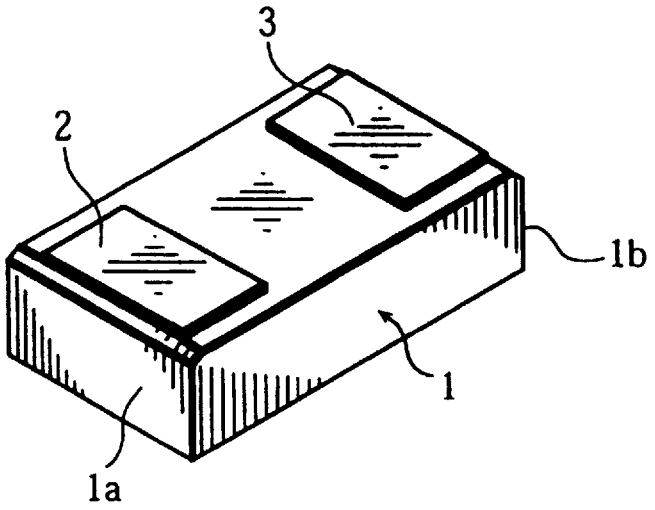
FIGS. 2–8 are perspective views illustrating sequential steps for making the same chip resistor.

First, as shown in FIG. 2, a pair of upper surface electrodes 2, 3 are formed on the upper surface of a chip-type insulating substrate 1 to be spaced from each other. This step may be performed in a manner such that a predetermined pattern of a suitable conductive paste is applied by screen-printing and then the pattern is baked in a heating furnace.

Figure 3:
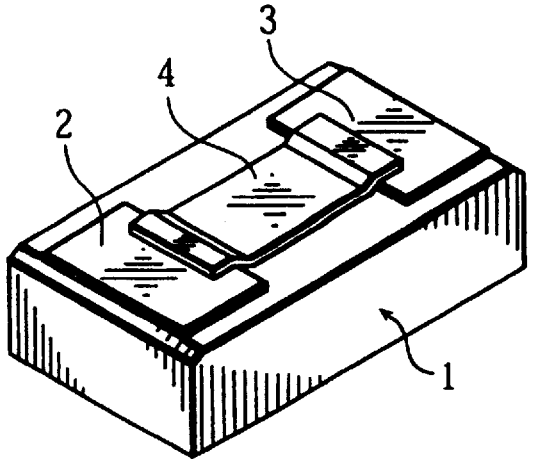

Then, as shown in FIG. 3, a resistor film 4 having a thickness of 15–30 μm is formed on the upper surface of the insulating substrate 1 to partially overlap the upper surface electrodes 2, 3. This step may be performed in a manner such that a predetermined pattern of a suitable resistive paste is applied by screen-printing and then the pattern is baked in a heating furnace. The resistive paste may be selected, depending on a desired resistance, from a group including materials such as a silver-palladium paste (for low resistance), a carbon paste (for intermediate resistance) and a ruthenium oxide past (for high resistance), for example.

Figure 4:
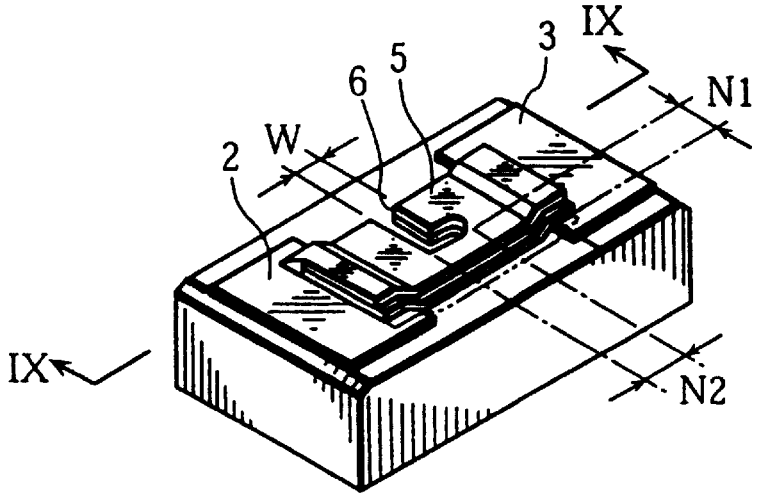

Then, as shown in FIG. 4, an undercoat layer 5 of glass having a thickness of e.g. 10 μm is formed on the resistor film 4 to cover the resistor film 4. This step may be performed in a manner such that a predetermined pattern of a suitable glass paste is applied by screen-printing and then the pattern is baked in a heating furnace.

Then, as also shown in FIG. 4, a trimming groove 6 is formed through the undercoat layer 5 and the resistor film 4 with the use of a laser beam irradiation for example. In this way, the overall resistance of the resistor film 4 is adjusted to fall within a predetermined acceptable range. It should be appreciated that the overall resistance of the resistor film 4 is mainly determined by the kind of the resistive material forming the resistor film 4, as well as by the width N1 and the length N2 of a narrowed portion of the resistor film 4 (that is, the cutting pattern of the trimming groove 6) which is the remaining portion after the trimming groove 6 is formed.

Figure 5:
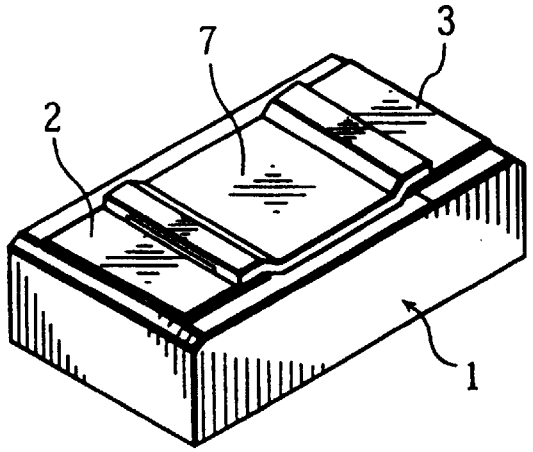

Then, as shown in FIG. 5, a middle-coat layer 7 of glass is formed on the upper surface of the undercoat layer 5 for covering the undercoat layer 5, while also filling up the trimming groove 6. This step may be also performed in a manner such that a predetermined pattern of a suitable glass paste is applied by screen-printing and then the pattern is baked in a heating furnace.

Figure 6:
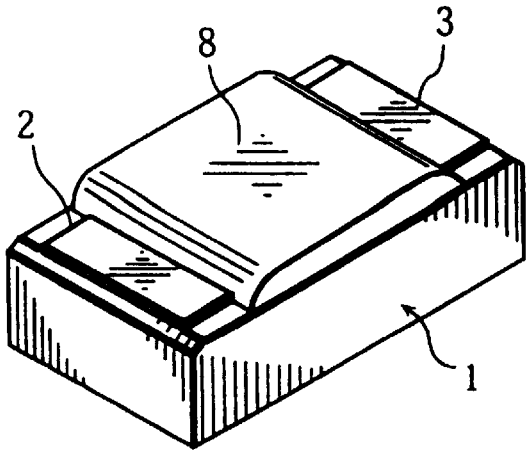

Then, as shown in FIG. 6, an overcoat layer 8 having a thickness of e.g. 20–25 μm is formed on the upper surface of the middle-coat layer 7 to entirely cover the middle-coat layer 7. This step may be also performed in a manner such that a predetermined pattern of a suitable glass paste is applied by screen-printing and then the pattern is baked in a heating furnace. The overcoat layer 8 may be made of a thermosetting resin for example.

Figure 7:
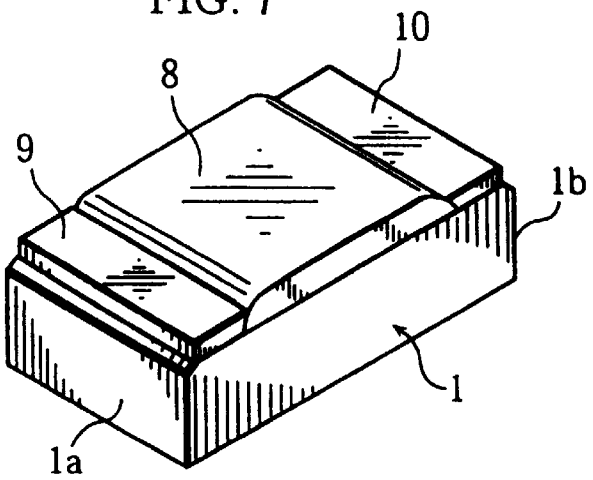

Then, as shown in FIG. 7, auxiliary electrodes 9, 10 are formed on the exposed upper surface portions of the main electrodes 2, 3, that is, the portions which are not covered by the overcoat layer 8. This step may be performed in a manner similar to the step of forming the main electrodes 2, 3.

Figure 8:
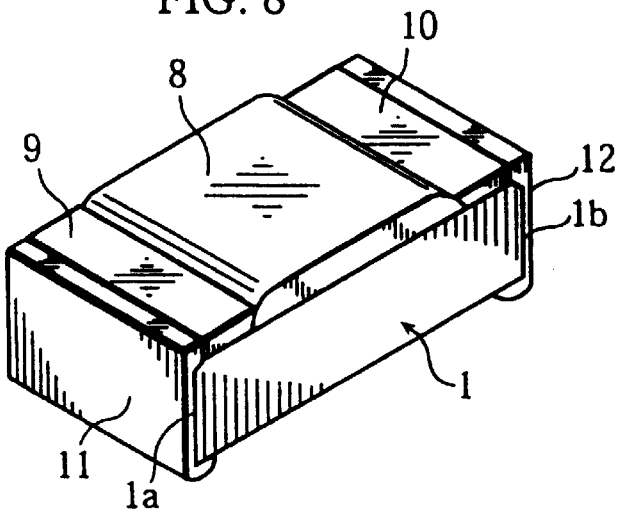

Then, as shown in FIG. 8, side electrodes 11, 12 are formed by baking a conductive paste applied on the pair of side surfaces 1*a*, 1*b* of the insulating substrate 1.

Finally, nickel-plating and solder-plating are sequentially performed for the entire chip to form metal plating layers 13, 14 (indicated by the phantom lines in FIG. 1) on the auxiliary electrodes 9, 10 and the side electrodes 11, 12.

The above method according to the present invention has the following two features.

The first feature resides in that the trimming groove 6 is formed to have a width W (see FIG. 9) of no less than 80 μm, which is greater than the conventional width of 40–60 μm. The second feature resides in that the middle-coat layer 7 is formed to have a thickness T (see also FIG. 9) of no greater than 10 μm, which is smaller than the conventional thickness of no less than 20 μm. It should be noted that "the width" of the trimming groove 6 used in the specification refers to the width of the bottom surface of the trimming groove 6.

The first feature is now described. When the width W of the trimming groove 6 is increased from the conventional 40–60 μm to no less than 80 μm, the glass paste for forming the middle-coat layer 7 readily enters the trimming groove 6. This holds for an instance where the middle-coat layer 7 has the conventional width of no less than 20 μm. As a result, bubbles are seldom trapped in the trimming groove 6 at the time of forming the middle-coat layer 7. Therefore, it is possible to surprisingly reduce the occurrence of pinholes which otherwise might be caused by trapped bubbles in the subsequent baking step. Even when bubbles are trapped in the trimming groove 6 in forming the middle-coat layer 7, they have little dimensions. Thus, the diameter of the pinholes formed in the baking step is much smaller than the width W of the trimming groove 6. Therefore, even when an amount of plating metal flows into the trimming groove 6 via the pinholes during the last plating step, it is possible to prevent shorting between the side surfaces 4*a*, 4*b* of the resistor film 4 at the trimming groove 6, thereby avoiding a large deviation from the adjusted resistance.

As previously described, the overall resistance of the trimmed resistor film 4 is mainly determined by the kind of the resistive material forming the resistor film 4 and by the cutting pattern of the trimming groove 6. Thus, the width W of the trimming groove 6 does not have direct relation to resistor adjustment, and little attention was conventionally paid to the width W of the trimming groove 6.

However, through extensive study, the inventor noticed that the width W of the trimming groove 6 was closely related to the pinhole formation which leads to the occurrence of rejective resistance, and has found that the pinhole formation is remarkably reduced when the groove width W is increased from the conventional 40–60 μm to no less than 80 μm. Therefore, the technical significance of the present invention should not be evaluated only by the fact that the width W of the trimming groove 6 is rendered no less than 80 μm, but be evaluated on the premise that the causal relation between the width W of the trimming groove 6 and the occurrence of rejective resistance has been studied.

Figure 9:
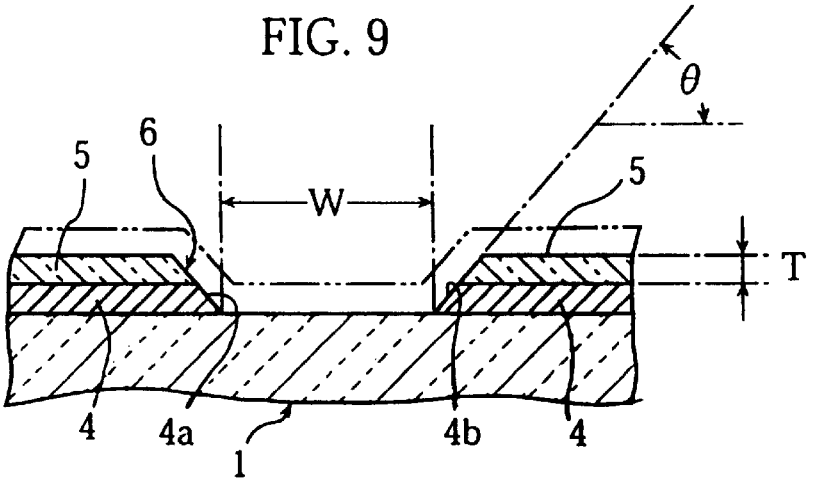
FIG. 9 is a sectional view along lines IX—IX in FIG. 4.

Regarding the first feature, it is preferable that the trimming groove 6 is inverted-trapezoidal in cross section (that is, becoming wider as far away from the upper surface of the substrate 1), as shown in FIG. 9. Such an arrangement further reduces the number of bubbles trapped in the trimming groove 6 in forming the middle-coat layer 7. It is particularly advantageous that the side surface 4*a* (or 4*b*) at the trimming groove 6 has an inclination angle θ of 20–40 degrees.

The trimming groove 6 having a width W of no less than 80 μm may be formed by two methods as follows.

Specifically, according to the first method, it is possible to utilize the same laser beam irradiating device as used for forming a conventional trimming groove having a width of 40–60 μm. However, to make a groove having a width W of no less than 80 μm, the surface of the undercoat layer 5 is shifted by a suitable amount from the focal point of the convex lens of the optical system incorporated in the laser beam irradiating device. In this way, the width W of the trimming groove 6 is made no less than 80 μm, while the cross-section of the trimming groove 6 is made trapezoidal. The first method is advantageous in that no modification is necessary for a conventionally available laser beam irradiating device itself.

The second method for making a trimming groove 6 having a width W of no less than 80 μm utilizes a laser beam irradiating device incorporating a convex lens of the optical system whose magnification is smaller than that of the conventional device. For the convex lens having a reduced magnification, the diameter of the laser beam at the focal point (or in the vicinity thereof) becomes greater, thereby making the width W of the trimming groove 6 no less than 80 μm.

There is no particular upper limit to the width W of the trimming groove 6. However, it is apparent that the groove width W cannot be made larger than the distance between the main electrodes 2, 3. Further, in relation to the diameter of the laser beam, a practically possible groove width W may be no greater than 150 μm.

On the other hand, the second feature resides in that the middle-coat layer 7 has a thickness T of no greater than 10 μm. According to this feature, the glass paste for the middle-coat layer 7 readily fills up every corner of the trimming groove 6, thereby hardly trapping bubbles, even when the width W of the trimming groove 6 falls within a range of conventional 40–60 μm. As a result, it is possible to substantially prevent the formation of pinholes communicating with the exterior in the baking step for the middle-coat layer 7. Further, even if bubbles are trapped in the trimming groove 6 in forming the middle-coat layer 7, the bubbles have small dimensions, and thus the diameters of the pinholes formed in the baking step are much smaller than the width W of the trimming groove 6. Therefore, even when an amount of plating metal flows into the trimming groove 6 via the pinholes during the last plating step, it is possible to prevent shorting between the side surfaces 4*a*, 4*b* of the resistor film 4 at the trimming groove 6, thereby avoiding a large deviation from the adjusted resistance.

Like the width W of the trimming groove 6, the middle-coat layer 7 itself is not a factor to determine the overall resistance of the resistor film 4, and conventionally little attention was paid to the thickness T of such a middle-coat layer. Thus, like the width W of the trimming groove 6, the technical significance of forming the middle-coat layer 7 to have a thickness of no greater than 10 μm according to the present invention should be evaluated on the premise that the causal relation to the occurrence of rejective resistance.

To form a middle-coat layer 7 having a thickness T of no greater than 10 μm, a screen having a finer mesh than was conventionally utilized may be used for printing a glass paste. However, there is a limit to practically obtainable mesh size. Therefore, the thickness T of the middle-coat 7 is substantially limited to a range of 5–10 μm.

The table below shows results of experiments which were conducted for confirming advantages of the present invention. Referring to the table, total sample numbers of Comparative example, Embodiment 1 and Embodiment 2 are 960, respectively. The "groove width" refers to the width W of the trimming groove 6 shown in FIG. 9, and the range shows a variation among samples. The "layer thickness" refers to the thickness T of the middle-coat layer 7 shown in FIG. 9, and the range shows a variation among samples.

TABLE

| Kind | Total Number of Samples | Number of Samples with Pinholes | Groove Width (μm) | Layer Thickness (μm) | Pinhole Diameter (μm) |
|---|---|---|---|---|---|
| Comparison | 960 | 395 | 49–60 | about 20 | 41–55 |
| Embodiment 1 | 960 | 153 | 49–54 | 8–10 | 10–48 |
| Embodiment 2 | 960 | 9 | 90–105 | about 20 | 14–28 |

The 960 samples of the comparative example correspond to conventional chip resistors, and as is clearly seen from the table, the widths W of their trimming grooves fall within a range of 49–60 μm, and the thicknesses T of their middle-coat layers are about 20 μm. Of the 960 samples in total, 395 samples were formed with pinholes. Besides, the diameters of the pinholes are 41–55 μm, which range overlaps the range of the groove widths W. Thus, it is expected that a substantially large number of samples out of the total samples will have rejective resistance.

On the other hand, for Embodiment 1, the thicknesses T of their middle-coat layers are rendered no greater than 10 μm, whereas the widths W of their trimming grooves are 49–54 μm like the conventional devices. As a result, of the 960 samples in total, the number of samples formed with pinholes is reduced to 153 (fewer than the half, compared with the comparative example). Besides, even when pinholes are formed, their diameters are reduced to 10–40 μm. Thus, it is expected that the occurrence of rejective resistance is remarkably reduced, compared with the comparative example.

Further, for Embodiment 2, the thicknesses T of the middle-coat layers are about 20 μm like the comparative example, whereas the widths W of the trimming grooves are rendered to fall within a range of 90–105 μm. As a result, for the 960 samples in total, the number of samples formed with pinholes is drastically reduced down to 9 (which is 1/40 of that of the comparative example). Besides, even when pinholes are formed, their diameters are 14–28 μm, which are much smaller than the widths W of the trimming grooves. Thus, it is expected that the occurrence of rejectable resistance is reduced down to substantially zero.

The above table does not show an embodiment wherein the width of the trimming groove is no less than 80 μm and the thickness T of the middle-coat layer is no greater than 10 μm. However, it is well expected from the results of Embodiment 1 and Embodiment 2 that synergistic effect by these embodiments is obtainable. However, it may not be particularly necessary to expect the synergistic effect, since even the single effect obtainable by forming the width W of the trimming groove to be no less than 80 μm sufficiently reduces the occurrence of rejective resistance (Embodiment 2).

According to the above embodiments, each insulating substrate is formed with one resistor film. However, the present invention is also applicable to a so-called network-type chip resistor wherein one insulating substrate is formed with a plurality of resistor films, as disclosed in Japanese Patent Application Laid-open No. 4-17308 for example.

What is claimed is:

1. A chip resistor comprising:

an insulating substrate;

a pair of main electrodes formed on a surface of the insulating substrate and spaced from each other;

a resistor film formed on the surface of the insulating substrate to bridge between the main electrodes, the resistor film being provided with a trimming groove for resistance adjustment;

a protective coating formed to cover the resistor film; and a metal plating formed in electrical conduction with each of the main electrodes;

wherein the trimming groove has a width which is no less than 80 μm but smaller than an interval between the main electrodes;

wherein the trimming groove is inverted-trapezoidal in cross section: and wherein the trimming groove has a pair of inclined side surfaces, each of the inclined side surfaces has an inclination angle of 20–45 degrees.

2. The chip resistor according to claim 1, wherein the width of the trimming groove is 90–150 μm.

3. The chip resistor according to claim 1, wherein the protective coating includes an undercoat layer of glass formed on the resistor film, a middle-coat layer of glass formed on the undercoat layer, and an overcoat layer formed on the middle-coat layer, the trimming groove being formed through the undercoat layer and the resistor film.

4. The chip resistor according to claim 3, wherein the middle-coat layer has a thickness of 5–10 μm.

5. The chip resistor according to claim 1, further comprising an auxiliary electrode formed on each of the main electrodes, and a side electrode formed on a side surface of the insulating substrate in electrical conduction with the auxiliary electrode and said each main electrode, the metal plating being formed to cover the auxiliary electrode and the side electrode.

6. A chip resistor comprising:

an insulating substrate;

a pair of main electrodes formed on a surface of the insulating substrate and spaced from each other;

a resistor film formed on the surface of the insulating substrate to bridge between the main electrodes, the resistor film being provided with a trimming groove for resistance adjustment;

a protective coating formed to cover the resistor film; and a metal plating formed in electrical conduction with each of the main electrodes;

wherein the protective coating includes an undercoat layer of glass formed on the resistor film, a middle-coat layer of glass formed on the undercoat layer, and an overcoat layer formed on the middle-coat layer, the trimming groove being formed through the undercoat layer and the resistor film; and wherein the middle-coat layer has a thickness of 5–10 μm.

7. The chip resistor according to claim 6, wherein the trimming groove is inverted-trapezoidal in cross section.

8. The chip resistor according to claim 7, wherein the trimming groove has a pair of inclined side surfaces, each of the inclined side surfaces has an inclination angle of 20–45 degrees.

9. The chip resistor according to claim 6, further comprising an auxiliary electrode formed on each of the main electrodes, and a side electrode formed on a side surface of the insulating substrate in electrical conduction with the auxiliary electrode and said each main electrode, the metal plating being formed to cover the auxiliary electrode and the side electrode.

10. A method of making a chip resistor comprising the steps of:

forming a pair of main electrodes on a surface of an insulating substrate to be spaced from each other;

forming a resistor film on the surface of the insulating substrate to bridge between the main electrodes;

forming an undercoat layer of glass to cover the resistor film;

forming a trimming groove through the undercoat layer and the resistor film for resistance adjustment;

forming a middle-coat layer of glass to cover the undercoat layer;

forming an overcoat layer to cover the middle-coat layer; and forming a metal plating in electrical conduction with each of the main electrodes;

wherein the step of forming the trimming groove is performed so that the trimming groove has a width which is no less than 80 μm but smaller than an interval between the main electrodes, the trimming groove being inverted-trapezoidal in cross section, the trimming groove having a pair of inclined side surfaces, each of the inclined side surfaces having an inclination angle of 20–45 degrees.

11. The method according to claim 10, wherein the step of forming the trimming groove is performed so that the width of the trimming groove is 90–150 μm.

12. The method according to claim 10, wherein the step of forming the middle-coat layer is performed so that the middle-coat layer has a thickness of 5–10 μm.

13. A method of making a chip resistor comprising the steps of:

forming a pair of main electrodes on a surface of an insulating substrate to be spaced from each other;

forming a resistor film on the surface of the insulating substrate to bridge between the main electrodes;

forming an undercoat layer of glass to cover the resistor film;

forming a trimming groove through the undercoat layer and the resistor film for resistance adjustment;

forming a middle-coat layer of glass to cover the undercoat layer;

forming an overcoat layer to cover the middle-coat layer; and forming a metal plating in electrical conduction with each of the main electrodes;

wherein the step of forming the middle-coat layer is performed so that the middle-coat layer has a thickness of 5–10 μm.

14. The method according to claim 13, wherein the step of forming the trimming groove is performed so that the trimming groove is inverted-trapezoidal in cross section.

15. The method according to claim 14, wherein the step of forming the trimming groove is performed so that the trimming groove has a pair of inclined side surfaces which have an inclination angle of 20–45 degrees.

16. A chip resistor comprising:

an insulating substrate;

a pair of main electrodes formed on a surface of the insulating substrate and spaced from each other;

a resistor film formed on the surface of the insulating substrate to bridge between the main electrodes, the resistor film being provided with a trimming groove for resistance adjustment;

a protective coating formed to cover the resistor film; and a metal plating formed in electrical conduction with each of the main electrodes;

wherein the trimming groove is inverted-trapezoidal in cross section; and wherein the trimming groove has a pair of inclined side surfaces, each of the inclined side surfaces has an inclination angle of 20–45 degrees.

17. A method of making a chip resistor comprising the steps of:

forming a pair of main electrodes on a surface of an insulating substrate to be spaced from each other;

forming a resistor film on the surface of the insulating substrate to bridge between the main electrodes;

forming an undercoat layer of glass to cover the resistor film;

forming a trimming groove through the undercoat layer and the resistor film for resistance adjustment;

forming a middle-coat layer of glass to cover the undercoat layer;

forming a overcoat layer to cover the middle-coat layer; and forming a metal plating in electrical conduction with each of the main electrodes;

wherein the step of forming the trimming groove is performed so that the trimming groove is inverted-trapezoidal in cross section, the trimming groove having a pair of inclined side surfaces, each of the inclined side surfaces having an inclination angle of 20–45 degrees.

* * * * *